United States Patent [19]

Calabrese

[11] 4,362,395

[45] Dec. 7, 1982

[54] DEVICE FOR WINDING AND SETTING A TIMEPIECE

[75] Inventor: Vincent Calabrese, Lausanne, Switzerland

[73] Assignee: Corum, Ries, Bannwart & Co., Switzerland

[21] Appl. No.: 196,120

[22] Filed: Oct. 10, 1980

[30] Foreign Application Priority Data

Oct. 19, 1979 [CH] Switzerland ..... 9400/79

[51] Int. Cl.[3] ..... G04B 27/00

[52] U.S. Cl. ..... 368/146; 368/289

[58] Field of Search ..... 368/190, 191, 288–290, 368/319, 206, 216, 308, 145, 146

[56] References Cited

U.S. PATENT DOCUMENTS

| | | | |
|---|---|---|---|
| 720,258 | 2/1903 | Kuenzel | 368/191 |
| 1,845,440 | 2/1932 | Piguet | 368/191 |
| 3,879,933 | 4/1975 | Ikehata | 368/191 |
| 3,916,615 | 11/1975 | Maeda | 368/191 |
| 4,104,866 | 8/1978 | Chappatte | 368/319 |

FOREIGN PATENT DOCUMENTS

| | | | |
|---|---|---|---|
| 1212893 | 3/1966 | Fed. Rep. of Germany | 368/191 |
| 582908 | 12/1976 | Switzerland | 368/289 |

*Primary Examiner*—Bernard Roskoski

[57] ABSTRACT

A winding and setting arrangement for a timepiece comprises a two-part stem extending through the hollow shaft of the spring drum. The outer part of the stem is affixed at its outer end to a crown and at its inner end has Breguet teeth which, in an inner position of the stem, are engageable with Breguet teeth of a connecting member which is non-rotatable but axially movable in a cavity in the hollow spring drum shaft. A spring urges the connecting member outwardly against a shoulder in the shaft. The inner part of the stem is coupled with the outer part by a square section so that the two parts rotate together but are axially movable relative to one another. The inner stem part passes freely through the connecting member and, inwardly of the spring drum, carries a pinion which is engageable with a setting wheel in an outer position of the stem. A spring urges the inner stem part outwardly.

8 Claims, 2 Drawing Figures

DEVICE FOR WINDING AND SETTING A TIMEPIECE

The object of the present invention is a timepiece winding and setting arrangement wherein the winding stem is mounted slidably in the shaft, which is hollow, of the spring drum and carries a pinion intended to come into engagement with a wheel of the timepiece movement.

Such an arrangement is described in Swiss Pat. No. 128 779. In this prior arrangement, which was developed for use in narrow movements of the so-called "baguette" type in which, due to the lack of space, it is difficult to arrange the winding stem parallel to the dial, the connecting means, of Breguet type, is provided between the crown and a wheel mounted on an extension of the shaft of the spring drum. This arrangement of the connecting members makes it impossible to provide a construction which is sealed with respect to dust. The extension of the spring drum shaft makes the assembly relatively high.

The present invention seeks to provide an arrangement which is capable of being mounted on a dust-proof crown of small height, using the space within the height of the spring drum.

The arrangement according to the invention is characterised in that the stem is formed by two separate parts of which one passes freely through a connecting member which is fixed in respect of rotary movement to the shaft of the spring drum and is intended to come into engagement with connecting means provided on the other part of the stem.

The winding mechanism is entirely disposed within the shaft of the spring drum, within the thickness of the spring drum. The stem may be secured in conventional manner to a dust-proof crown. The assembly is particularly compact.

The accompanying drawing shows an embodiment of the invention, given by way of example.

Figure 1:
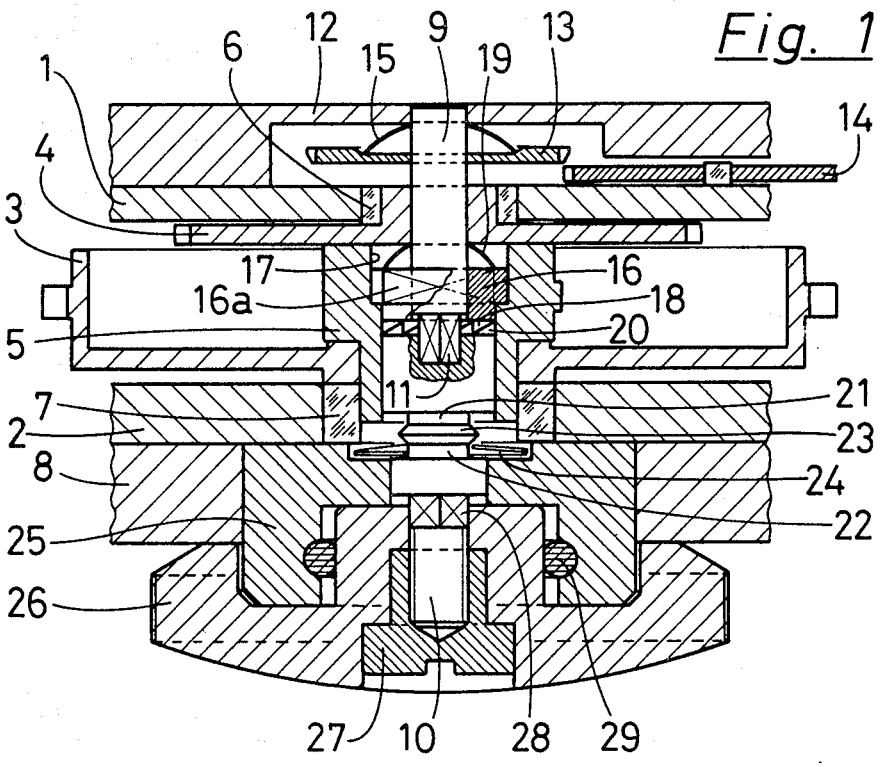
FIG. 1 shows a view in axial section of the arrangement in the winding position.

The drawing shows, in cross-section, part of a watch casing enclosing a movement, for example and elongate, narrow movement, comprising a plate 1 and a lower bridge support 2 between which is mounted a spring drum 3 provided with a ratchet 4 secured to the shaft 5 or hub of the spring drum, the ratchet 4 being pivotally mounted in the plate 1 by means of a jewel 6, while the shaft 5 is pivotally mounted in the bridge support 2 by means of a jewel 7. The movement is fixed directly against the casing base 8. The remainder of the casing, for example a narrow rectangular casing, is not shown in the drawing. Likewise, the drawing does not show the drive spring housed in the spring drum 3.

The hollow shaft 5 of the spring drum has passed through it a winding stem formed by two separate and connected parts 9 and 10. The part 9 which is cylindrical is provided with a square portion 11 by means of which it is coupled to the end of the other part 10 of the stem. The part 9 passes freely through the ratchet 4 and is pivotally mounted in an upper bridge support 12 of the movement. Fixed on the stem 9 is a pinion 13 which is intended to come into engagement with a setting wheel 14 which is pivotally mounted on the plate and which is engaged with the timepiece movement.

Mounted between pinion 13 and the upper bridge support 12 is a curved spring 15, referred to as a foil spring, which operates in a compression mode and which tends to urge the pinion 13 and consequently the winding stem, towards the plate.

The part 9 of the stem also passes freely through a member 16 which is mounted slidably in a housing 17 of the spring drum shaft 5 and which comes to bear against a shoulder of the shaft 5. The member 16 serves as a sliding pinion and has a Breguet tooth assembly 18. The member 16 is subjected to the action of a curved return spring 19 which is similar to the spring 15 and which bears against the ratchet 4. In contrast to a conventional sliding pinion, the member 16 does not have a second tooth assembly but is fixed with respect to the shaft 5 by a simple flat portion 16*a*. Any other shape which is not totally circular could be employed for that purpose.

The other part 10 of the stem is also provided with a Breguet tooth assembly 20 which co-operates with the Breguet tooth assembly 18 of the member 16. The part 10 of the stem also has two annular grooves 21 and 22 which are separated from each other by an annular double cone portion 23 co-operating with a spring 24 of annular or disc configuration, which is housed in a recess in a circular member 25 acting as a tube for a crown 26, being held in place by the jewel 7. The spring 24 acts as a locating spring. It positions the stem in its winding position (FIG. 1) and its setting position (FIG. 2) respectively, by way of the two grooves 21 and 22 therein. The stem is fixed to the crown 26 by a nut 27 which is housed in the crown and which is screwed on to the screw-threaded end of the stem which is obliged to rotate with the crown 26 by virtue of a square portion 28. The assembly is sealed in per se known manner, by means of an O-ring seal 29 housed in a groove in the tube 25 and bearing against the smooth hub portion of the crown.

In the position shown in FIG. 1, it will be seen that the two Breguet tooth assemblies 18 and 20 are engaged with each other, and rotation, in a clockwise direction, of the crown 26 drives the spring drum shaft for winding up the spring. When the crown is turned in an anti-clockwise direction, the Breguet tooth assembly 20 slides over the teeth 18 moving the member 16 back against the force of the spring 19.

Figure 2:
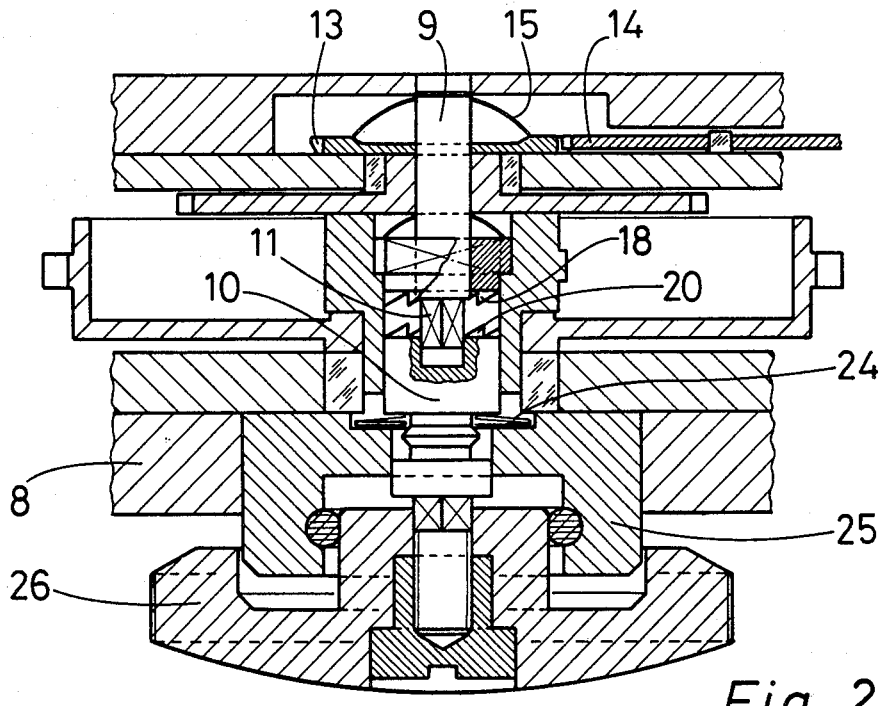
FIG. 2 shows the same device in the time setting position.

In the position shown in FIG. 2 the crown 26 has been moved away from the bottom 8 of the casing and the Breguet teeth 20 are no longer engaged with the teeth 18. On the other hand, the pinion 13 is in engagement with the setting wheel 14, thus permitting the time to be set. It should be noted that the provision of the spring 15 makes it possible to avoid chasing of the part 9 of the stem in the part 10.

It will be appreciated that the invention is not limited to the above-described embodiment, but many variations are possible, both in regard to the form of the 'sliding pinion', the connecting means, and the crown.

SUMMARY

The arrangement comprises a winding stem which is in two parts (9,10) which are non-rotatably fixed together, one part (9) passing freely through a connecting member (16) which is fixed in respect of rotation to the shaft of the spring drum (5), acting as a sliding pinion and for that purpose being provided with a Breguet tooth assembly co-operable with a Breguet tooth assembly on the other part of the stem (10). In the time setting position, a pinion (13) which is fixed with respect to one of the parts of the stem (9) is engaged by a spring with a countergear (14).

I claim:

1. A winding and setting assembly for a timepiece comprising a spring drum with a hollow shaft, a rachet secured to said shaft and a setting wheel for the timepiece, a connecting member in said hollow shaft and fixed for rotation therewith, a rotatable and axially movable two-part stem extending through said hollow shaft and comprising a first part which extends freely through said connecting member and carries a pinion engageable with said setting wheel in one axial position of said stem to set said timepiece, and a second part carrying driving means engageable with cooperating driving means on said connecting member in another axial position of said stem to rotate said shaft and thereby wind said timepiece.

2. A winding and setting assembly according to claim 1, in which said driving means carried by said second stem part are integral with said second stem part.

3. A winding and setting assembly according to claim 1, in which said cooperating driving means on said second stem part and said connecting member comprise Breguet tooth assemblies.

4. A winding and setting assembly according to claim 1, in which said connecting member is received in a housing in said hollow shaft and is coupled with said shaft by interengaging non-circular surfaces to rotate therewith while being movable axially of said shaft.

5. A winding and setting assembly according to claim 4, further comprising spring means for moving said connecting member axially of said hollow shaft and an abutment in said shaft limiting movement of said connecting member by said spring means.

6. A winding and setting assembly according to claim 1, in which said two stem parts are coupled by means restraining said parts to rotate together while permitting axial movement of said parts relative to one another.

7. A winding and setting assembly according to claim 6, further comprising means acting on said pinion on said first stem part in a direction to move said first stem part toward said second stem part and to move said pinion into engagement with said setting wheel.

8. A winding and setting assembly according to claim 1, in which a crown fixed to said second stem part is rotatable in a tube and a seal is provided between said crown and said tube.

* * * * *